United States Patent [19]

Selman

[11] 4,134,338

[45] Jan. 16, 1979

[54] STENCIL EJECTOR

[75] Inventor: Thomas G. Selman, London, England

[73] Assignee: Gestetner Limited, London, England

[21] Appl. No.: 746,715

[22] Filed: Dec. 2, 1976

[30] Foreign Application Priority Data

Oct. 27, 1976 [GB] United Kingdom ..... 3094/76

[51] Int. Cl.[2] ..... B41F 15/08; B41F 15/34

[52] U.S. Cl. ..... 101/122; 101/127.1

[58] Field of Search ..... 101/116, 118, 122, 132, 101/132.5, 141, 142, 364, 144, 232; 271/34, 188; 425/369, 370; 197/151

[56] References Cited

U.S. PATENT DOCUMENTS

| | | | |
|---|---|---|---|
| 1,748,389 | 2/1930 | Marcel | 425/369 X |
| 3,094,924 | 6/1963 | Stark | 101/364 X |
| 3,330,399 | 7/1967 | Tumavicus | 197/151 |
| 3,648,603 | 3/1972 | Kaminstein | 101/132.5 |
| 3,738,642 | 6/1973 | Blaire | 271/34 X |
| 3,788,221 | 1/1974 | Borneman | 101/116 |
| 3,793,950 | 2/1974 | Kaneko et al. | 101/142 |
| 3,874,290 | 4/1975 | Suzuki | 101/132.5 |
| 3,904,017 | 9/1975 | Frechette | 197/151 |

FOREIGN PATENT DOCUMENTS

| | | | |
|---|---|---|---|
| 2350671 | 4/1974 | Fed. Rep. of Germany | 101/128.1 |

*Primary Examiner*—Ronald E. Suter
*Attorney, Agent, or Firm*—Fleit & Jacobson

[57] ABSTRACT

A stencil duplicator includes stencil ejection apparatus including a mechanism to release the clamp for the stencil head, a guide to lead the head, as the duplicator rotates, to drive members which forward the used stencil into a container in which it is folded or creased so as to be foreshortened and stored with other stencils in a small space prior to disposal.

12 Claims, 5 Drawing Figures

STENCIL EJECTOR

This invention relates to a stencil duplicating machine having a stencil ejector.

The most awkward operation in a stencil duplicating process is the removal and disposal of a stencil at the end of a run. The stencil is removed from the duplicator by its heading, and the operator then has to dispose of the stencil, which is a large ink covered sheet.

The aim of the present invention is to reduce this difficulty.

The present invention provides, a stencil duplicator having a rotary surface upon which stencils are to be positioned, a clamp for clamping stencil heads upon the surface and stencil ejection apparatus including a mechanism operable to release the clamp during rotation of the surface whereby the head of a stencil on the surface will be raised therefrom, opposed drive members so positioned adjacent the surface as to receive a so raised stencil head between them upon continued rotation of the surface and a container mounted adjacent the drive members, the drive members being effective to draw a stencil from the surface and pass it into the container at a speed corresponding to the speed of movement of the surface.

The invention is applicable to both single and double cylinder duplicators. In a double cylinder machine, the stencils are preferably initially detached or ejected when the rotary surface, i.e. the screen, is passing round one or other cylinder, although detachment could be affected along the stencil path between the cylinders.

There may advantageously be provided a guide adjacent the drive members to be engaged by a raised stencil head and to ensure feeding thereof to the drive members. Preferably the guide is a wire parallel to the axis of rotation of the surface, but stripper fingers may, be used.

The clamp for clamping the head of the stencil on the cylinder, or in the case of a two cylinder machine, on the screen, may be an elongate member of U-shaped cross section to engage the edge of the head, which member is pivotable, preferably by a cam arrangement, to lift the leading edge of the head off retaining pins which normally engage in apertures in the head.

The drive members may include one or more pairs of toothed wheels so as to rumple or crinkle the used stencils so that their length is reduced as they are passed to the container. The drive members may lead stencils to a conveyor, which may be further effective to crease the stencils, or may lead directly to the interior of the container. In the former case there may be further wheels at the end of the conveyor, while the conveyor may comprise a toothed conveyor belt which engages against a roller and forwards the used stencils while thus shortening them. Guides can advantageously be provided to keep the stencils on the conveyor belt downstream of the roller. The drive members and conveyor where provided will operate at the same speed as the surface speed of the stencil screen or cylinder so that the stencil is drawn off smoothly.

The container may, and usually will be considerably less large than the size of a normal stencil, and in this case the stencil will become crumpled and compressed within the confines of the container as it is fed thereinto. A preferred feature in the box is a presser member for compressing ejected stencils received therein. This may be slideable or pivotable within the box. Preferably, it is coupled to a cover of the machine, such that it makes a downward pressing movement when the cover is lifted, for instance for the purpose of fixing a new stencil. In this way, a greater number of stencils can be collected in the box before the box needs to be emptied.

In order to make disposal of used stencils easier, disposable liners are preferably provided in the box to receive the stencils. The liners may be of plastics or cardboard and are foldable so that used stencils can be held within them and need not be touched by an operator who is emptying the box.

The invention will be more clearly understood by the following description which is given by way of example only with reference to the accompanying drawings in which.

Figure 1:
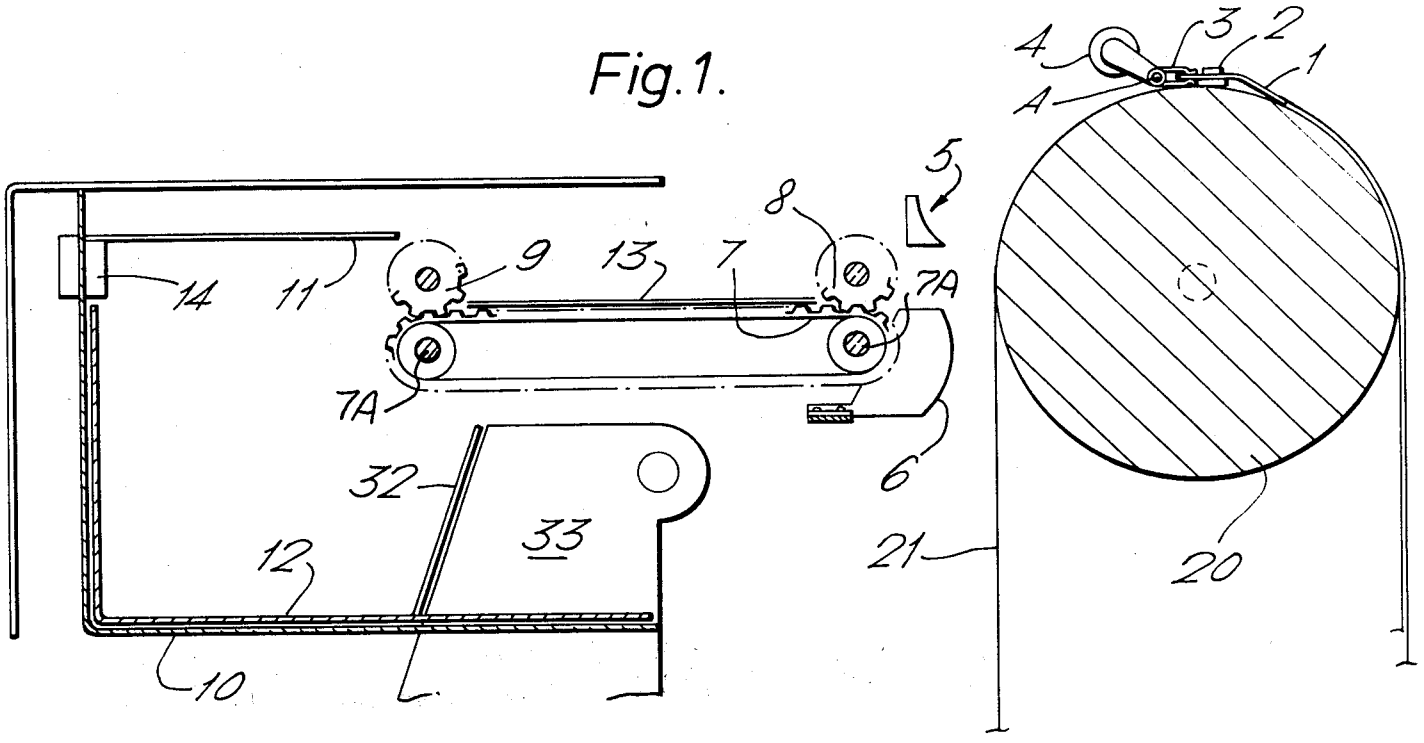
FIG. 1 is a side view showing a cylinder of a stencil duplicator together with one form of ejecting apparatus.

In the side view of FIG. 1, one cylinder of a double cylinder duplicator is shown at 20, and at 21 is shown the screen which passes round that cylinder and the other cylinder which is not shown. In the Figures, a stencil is shown on the screen, its head being indicated at 1. In the usual way, the head has a number of perforations in which engage pins which are mounted on the screen and of which one is shown at 2. The leading edge of the head, beyond the pins from the remainder of the stencil, is shown held in a U-shaped clamp 3. The clamp 3 is pivotable about its axis A upon depression of a cam follower 4. The follower 4 can be depressed by a cam shown at 5, which will be moved into the operating position shown when it is desired to eject a stencil. In an ejection operation, increasing pivoting of the clamp 3 will cause the leading edge of the stencil to be raised from the screen, and be moved to be released from the clamp 3 and to engage guides shown at 6 which will then guide the leading edge between intermeshing circulatory drive members having toothed surfacing means. In FIG. 1 the circulatory drive members are wheels 8 having toothed surfaces and other wheels therebelow carrying toothed surfacing means in the form of toothed conveyor belts 7 meshing with the toothed wheels 8. One or both of the rollers 8 and belts 7 are driven with the same peripheral speed as the screen 21 with the consequence that when the stencil is engaged between them it is drawn smoothly off the duplicator screen 21. The toothed arrangement causes the stencil to be foreshortened due to the wrinkling imparted thereto. The stencil is then conveyed by the conveyor belts 7 to toothed outlet rollers 9 and ejected into the box shown at 10. The stencil will be maintained in contact with the belts by guides 13 which are above the belts, though positioned to press downwardly upon the belts with slight pressure.

As shown, the box 10 includes a liner 12 which is disposable and will in itself be described in more detail below. Movable within the box 10 is a sliding presser 11 mounted on a boss 14. By an arrangement not shown, the presser 11 is lowered downwardly in the box when the cover of the machine is open. Opening will normally occur when it is desired to fit a new stencil after ejection of an old one and consequently the most recently ejected stencil in the box will be pressed downwardly into the liner 12. A number of used stencils can therefore be collected in the liner before it is necessary to empty the box.

Figure 2:
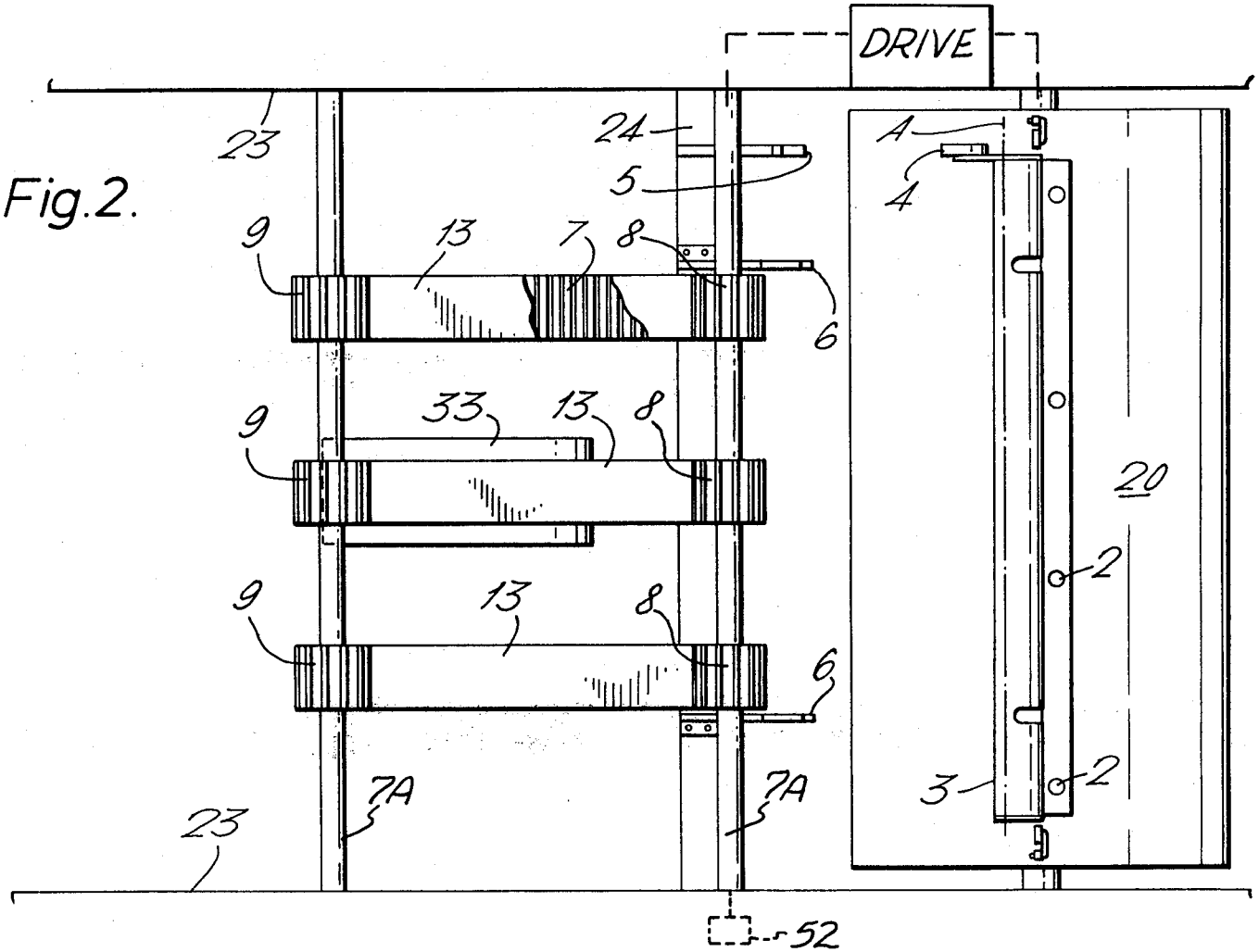
FIG. 2 is a view of the apparatus of FIG. 1 from above.

FIG. 2 is a view of the apparatus of FIG. 1 from above showing the cylinder 20 to be mounted between side frames 23 of the duplicator and illustrating the position of the cam follower 4 at one end of the retainer clamp 3. The cam 5 is in a corresponding position fixedly mounted on a cross member 24 extending between the side frames. Two guides 6 are provided to contact the leading ends of stencils to be ejected slightly inwardly of the edges thereof.

From this Figure it may be seen that there are three guides 13, three rollers 8 and three rollers 9 which are spaced apart across the width of the machine. There are also three belts, but in the FIG. 2 view these are hidden by the guide 13. The guides 13 are mounted on a cross member of the machine, and the rollers 8 and 9 are mounted on respective common axles not shown. The spindles 7A for the belts are also coaxial. The guides 13 hold the stencils upon the conveyor belt 7 for ensuring their conveyance towards the box.

Figure 3:
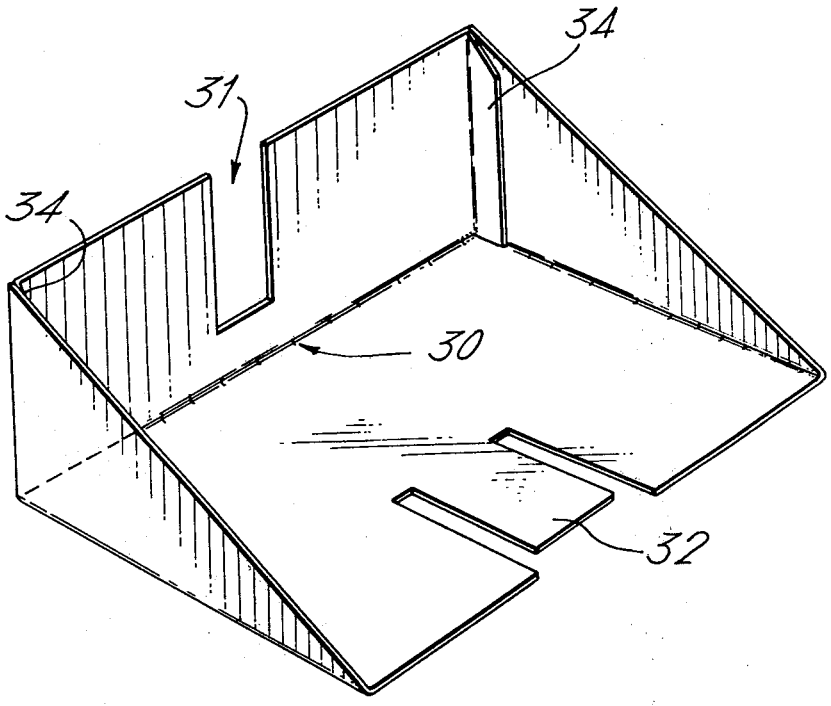
FIG. 3 is a perspective view of a liner to be positioned within the box of the described apparatus.

A perspective view of a liner for the box 10 is given in FIG. 3. The liner is foldable about its long inside edge, at 30, so that a collection of used stencils can be contained within the folded liner for disposal purposes. A slot 31 is provided in the back wall of the container and the boss 14 shown in FIG. 1 can move within this slot. The bottom wall is interupted by a flap 32 accommodating a frame part 33 of the machine. The liner is not secured along the edges 34. It may be of any suitable material such as cardboard or vacuum formed plastics.

Figure 4:
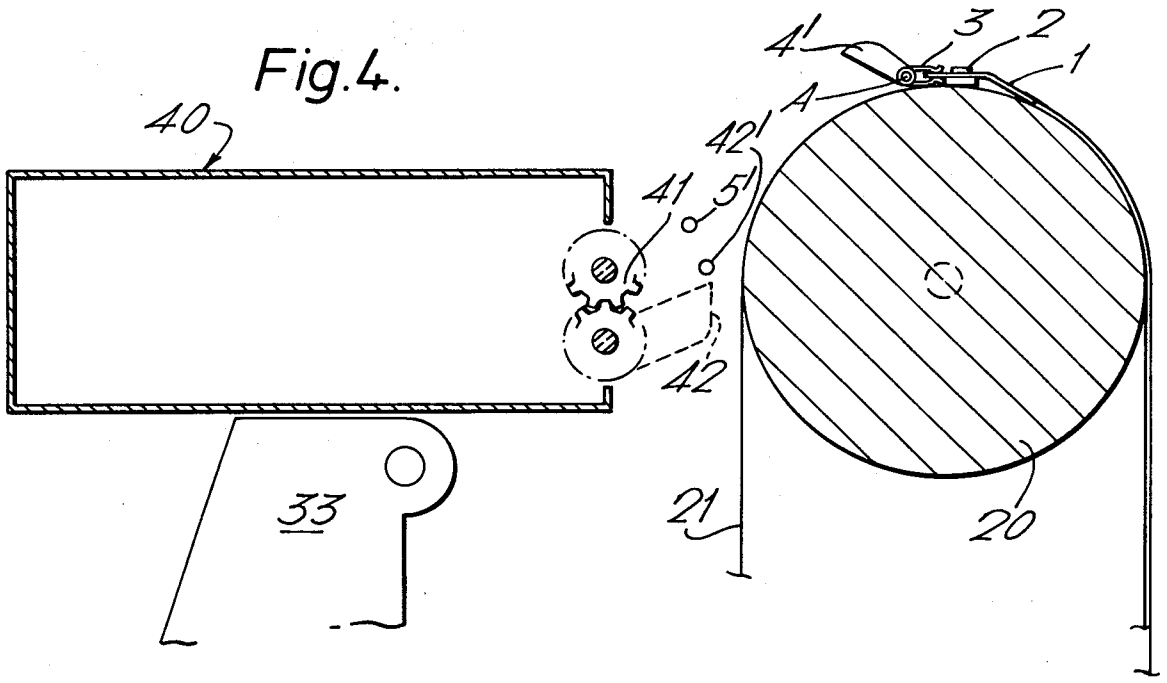
FIG. 4 is a side view similar to FIG. 1 but with a second form of ejecting apparatus.
Figure 5:
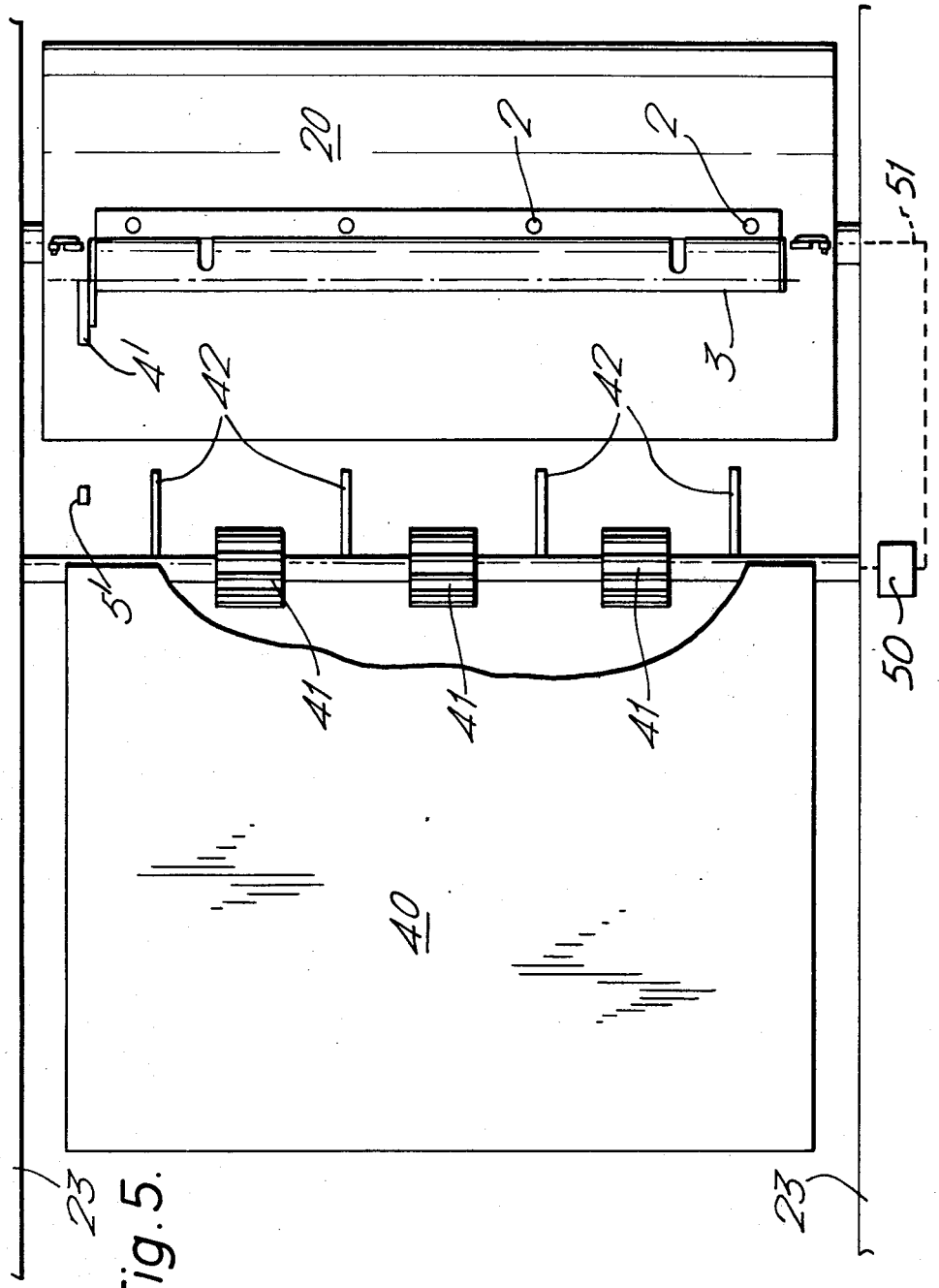
FIG. 5 is a view of the apparatus of FIG. 4 from above.

FIGS. 4 and 5 show a second form of ejection apparatus in a stencil duplicator, like parts being indicated by like reference numerals when compared with FIGS. 1 and 2. The main difference from the embodiment of FIGS. 1 and 2 is that the conveyor belts 7 are no longer provided. With this embodiment, the toothed surfacing means of all the drive members comprise surface teeth on the wheels 41. In use, and in use stencils are fed to the container 40 simply by a number of, typically three, pairs of inter-engaging toothed wheels 41 spaced along parallel axes. Located between the wheels 41 are plastics stripper fingers 42, which are effective to guide a raised head of a stencil on the screen 21 into the nips between the wheels 41. The fingers are shown in dashed lines in FIG. 4 which also illustrates an alternative guide arrangement, i.e. a cross wire shown at 42', which is between wheels 41 and the screen 21 and is similarly effective to guide a stencil head. Also, compared to the first embodiment the cam 5, is replaced with a peg 5', and the cam follower 4 by a cam shaped part 4' attached to the clamp 3 (see FIG. 4).

In this embodiment, the container 40 is of a different shape and is mounted above the frame part 33 of the duplicator. It is shorter than the length of a stencil so that stencils upon being fed in by the wheels 41, and partly creased thereby, will also be folded and compressed due to the confines of the container. It is found that, particularly if the box is of a height about the same as the height of the stencil head, the stencil will tend to fold or concertina within the container with folds of about that height. This means that they can pack quite neatly and to a considerable capacity within the container, and the capacity of the container 40 of FIG. 4 is found to be greater than that of the box of FIGS. 1 and 2. To ensure that an ejected stencil will always be received within the container a counter, such as counter 52 in FIG. 2 may be provided in either embodiment to indicate when a recommended number of stencils has been ejected and packed into the container. As the trailing edge of an ejected stencil may remain near the gear wheel 41, it is preferred for these to be driven via a one way drive connection from the drive of the screen 21 so that upon any reverse movement thereof an ejected stencil is not withdrawn from the container. Such a drive is shown at 51 in FIG. 5 as including a one-way clutch unit 50.

A similar liner may be provided and used within the container 40 as is illustrated in FIG. 3, suitably adapted as to shape. The container 40 preferably opens at the top in order that used and ejected stencils may be easily removed in the liner.

I claim:

1. A stencil duplicator comprising a rotary surface upon which stencils are to be positioned, a clamp on the surface for clamping stencil heads upon the surface, means for driving said rotary surface in a print direction at a printing speed and stencil ejection apparatus, said stencil ejection apparatus including:

(a) a mechanism operable to release the clamp during rotation of the surface, whereby the head of a stencil on the surface will be raised therefrom;

(b) circulatory drive members so positioned adjacent the surface as to receive a so raised stencil head between them upon continued rotation of the surface;

(c) a container mounted adjacent the circulatory drive members;

(d) intermeshing toothed surfacing means for forming toothed surfaces on said circulatory drive members; and (e) means for driving said circulatory members in use of the stencil ejection apparatus for conjoint circulation entraining said stencil along a direction to draw the stencil from the surface as it moves in said print direction by holding the stencil between said intermeshing toothed surfacing means of the respective drive members, and then to release it into the container at a speed corresponding to the speed of movement of said rotary surface when rotating at said printing speed.

2. A stencil duplicator as claimed in claim 1 wherein said stencil ejection apparatus further includes a guide adjacent said drive members to be engaged by a raised stencil head and to ensure feeding thereof to said drive members.

3. A stencil duplicator as claimed in claim 2 wherein said guide includes stripper fingers mounted adjacent said surface.

4. A stencil duplicator as claimed in claim 1, wherein said clamp is of U-shape and is pivoted on said surface such that upon release it acts to lift the head of a stencil from the surface.

5. A stencil duplicator as claimed in claim 1, wherein said circulatory drive members comprise at least one pair of wheels.

6. A stencil duplicator as claimed in claim 5, wherein said intermeshing toothed surfacing means comprise intermeshing teeth on the wheels.

7. A stencil duplicator as claimed in claim 5, wherein said toothed surfacing means on one of said wheels comprise a toothed conveyor belt leading from said one wheel to said container.

8. A stencil duplicator as claimed in claim 7, wherein said toothed surfacing means on the other of said wheels comprise teeth on said other wheel, in intermeshing engagement with said toothed conveyor belt.

9. A stencil duplicator as claimed in claim 8 and further including a toothed wheel adjacent the end of said conveyor belt remote from said pair of wheels.

10. A stencil duplicator as claimed in claim 1 wherein the container is shorter in the feed direction of the drive members than the length of a stencil.

11. A stencil duplicator as claimed in claim 1, including a counter to register the number of stencils received in the container.

12. A stencil duplicator as claimed in claim 1 including a one-way drive arrangement between said rotary surface and said drive members.

* * * * *